US010417873B2

(12) United States Patent
Hosokawa et al.

(10) Patent No.: US 10,417,873 B2
(45) Date of Patent: Sep. 17, 2019

(54) GAME SYSTEM, AND CONTROL METHOD AND COMPUTER READABLE STORAGE MEDIUM USED THEREFOR

(71) Applicant: Konami Digital Entertainment Co., Ltd., Minato-ku, Tokyo (JP)

(72) Inventors: Takayuki Hosokawa, Minato-ku (JP); Shinya Ito, Minato-ku (JP)

(73) Assignee: KONAMI DIGITAL ENTERTAINMENT CO., LTD., Tokyo (JP)

( * ) Notice: Subject to any disclaimer, the term of this patent is extended or adjusted under 35 U.S.C. 154(b) by 268 days.

(21) Appl. No.: 15/472,063

(22) Filed: Mar. 28, 2017

(65) Prior Publication Data

US 2017/0200343 A1 Jul. 13, 2017

Related U.S. Application Data

(63) Continuation of application No. PCT/JP2015/080900, filed on Nov. 2, 2015.

(30) Foreign Application Priority Data

Nov. 5, 2014 (JP) ..... 2014-225182

(51) Int. Cl.
*G07F 17/32* (2006.01)
*G07F 17/34* (2006.01)
(Continued)

(52) U.S. Cl.
CPC ..... *G07F 17/329* (2013.01); *A63F 3/06* (2013.01); *A63F 5/02* (2013.01); *G07F 17/3216* (2013.01); *G07F 17/3258* (2013.01); *G07F 17/34* (2013.01)

(58) Field of Classification Search
USPC ..... 463/19
See application file for complete search history.

(56) References Cited

U.S. PATENT DOCUMENTS

| | | | | |
|---|---|---|---|---|
| 8,251,807 | B2 * | 8/2012 | LeMay | A63F 13/12 463/29 |
| 2008/0096656 | A1 * | 4/2008 | LeMay | A63F 13/12 463/31 |
| 2008/0108417 | A1 * | 5/2008 | Sakuma | G07F 17/32 463/20 |

FOREIGN PATENT DOCUMENTS

| | | | | |
|---|---|---|---|---|
| JP | 2011067534 | A | 4/2011 | |
| WO | WO-2013146072 | A1 * | 10/2013 | G07F 17/3227 |

OTHER PUBLICATIONS

Notification of Reasons for Refusal (JP Patent Application No. 2014-225182); dated Sep. 7, 2017; Includes English Translation; 6 pages.

(Continued)

*Primary Examiner* — Pierre E Elisca
(74) *Attorney, Agent, or Firm* — Howard & Howard Attorneys PLLC

(57) ABSTRACT

Provided is a game system comprising an element selection device which selects some selective elements from a plurality of selective elements and controls a value for each of game elements displayed in a game screen based on the selection by the element selection device, wherein: a growth attribute and a modification attribute are set as factors which determine the value of the game element; and a change condition is set for each attribute in order to make a state of each attribute change in relation to the selection by the element selection device, and the value of the game element is controlled by changing the state of each attribute based on the selection by the element selection device and the change condition set for each attribute.

12 Claims, 12 Drawing Sheets

(51) Int. Cl.
*A63F 3/06* (2006.01)
*A63F 5/02* (2006.01)

(56) References Cited

OTHER PUBLICATIONS

Yusha no Kuseni Namai kida or2, Shukan Fami Tsu; Published: Oct. 31, 2008; 8 pages.
Yusha no Kuseni Namai kida or2, Shukan Fami T su, Publication Date: Oct. 31, 2008, 7 pages.
ISA/210 PCT International Search Report (PCT/JP2015/080900), dated Feb. 9, 2016, 3 pages.
ISA/237 PCT Written Opinion of the International Search Authority (PCT/JP2015/080900), dated Feb. 9, 2016, 9 pages.
Decision to Grant a Patent (JP Patent Application No. 2014-225182); dated Feb. 16, 2018.

* cited by examiner

FIG. 3

Game Progression Control

Plants are cultivated based on selections of numbers by a lottery mechanism and a change condition set for each of growth attribute and modification attribute.

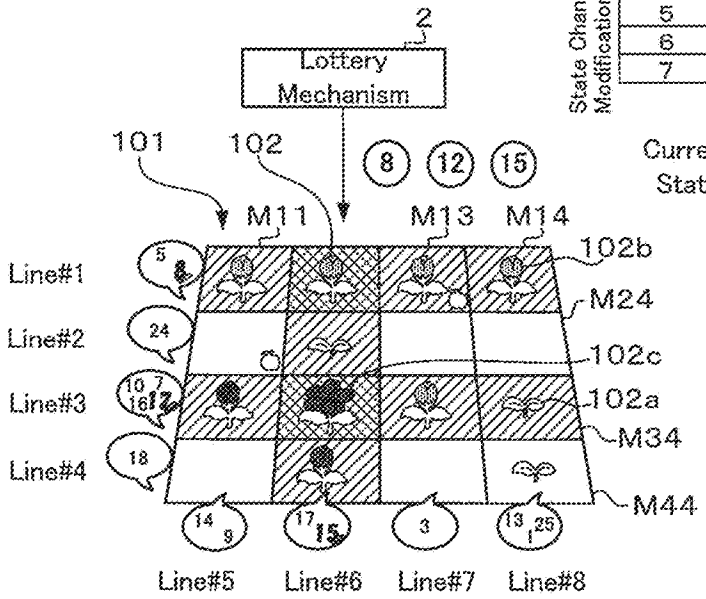

Changes of a Plant by Cultivation

State Change of Growth Attribute →

State Change of Modification Attribute ↓

| Level | Dividend | Image of No Hit | Image of 1 Hit | Image of Cross Hit |
|---|---|---|---|---|
| 0 | 0 | No | No | No |
| 1 | 0 | No | Sprout | Bue(yellow) |
| 2 | 4 | Sprout | Bud(yellow) | Flower(yellow) |
| 3 | 6 | Sprout | Bud(blue) | Flower(blue) |
| 4 | 10 | Sprout | Bud(red) | Flower(red) |
| 5 | 16 | Sprout | Bud(bronze) | Flower(bronze) |
| 6 | 50 | Sprout | Bud(silver) | Flower(silver) |
| 7 | 150 | Sprout | Bud(gold) | Flower(gold) |

Current State

Line Information Data 22

| | (Number、Hit Identification) |
|---|---|
| Line#1 | (5、0)、(8、1) |
| Line#2 | (24、0) |
| Line#3 | (7、0)、(10、0)、(12、1)、(16、0) |
| Line#4 | (18、0) |
| Line#5 | (14、0)、(9、0) |
| Line#6 | (15、1)、(17、0) |
| Line#7 | (3、0) |
| Line#8 | (1、0)、(13、0)、(25、0) |

Cell Information Data

| | Col.#1 | Col.#2 | Col.#3 | Col.#4 |
|---|---|---|---|---|
| Row#1 | 2 | 1 | 2 | 2 |
| Row#2 | 0 | 1 | 0 | 0 |
| Row#3 | 3 | 4 | 2 | 1 |
| Row#4 | 1 | 4 | 0 | 2 |

23

GAME SYSTEM, AND CONTROL METHOD AND COMPUTER READABLE STORAGE MEDIUM USED THEREFOR

CROSS-REFERENCE TO RELATED APPLICATION

This application is a continuation of PCT Application No. PCT/JP2015/080900, filed Nov. 2, 2015, which claims priority to Japanese Patent Application No. 2014-225182, filed Nov. 5, 2014, the disclosures of which are hereby incorporated by reference in their entirety.

TECHNICAL FIELD

The present invention relates to a game system and the like that includes an element selection device that selects some selective elements from a plurality of selective elements, and a value control device that controls the value of a game element displayed in a game image on the basis of that selection.

BACKGROUND ART

As a game system that controls the progression of a game according to elements that are selected from a plurality of selective elements, a bingo game machine is per se known (for example, Patent Literature #1) that establishes correspondence between a plurality of numbers that are the subjects to be selected by a lottery device which serves as an element selection device, and a plurality of numbers that are respectively allocated to each of a plurality of cells which serve as game elements, that makes the cells corresponding to the numbers which are selected activate in series, and that gives a reward to a user when the activated cells form some particular fixed arrangement.

CITATION LIST

Patent Literature

Patent Document #1: Japanese Laid-Open Patent Publication 2011-67534.

SUMMARY OF INVENTION

Technical Problem

In the game machine described above, correspondence is established on a one-to-one basis between the selective elements that are selected and the game elements, and the value of each game element is evaluated only from one type standpoint i.e. either activated or inactivated. Accordingly, there is a danger that the development of the game will become monotonous.

Accordingly, it is the object of the present invention to provide a game system and the like, that is capable of changing the value of a game element on the basis of selection of a selective element, in many different ways.

Solution to Technical Problem

One aspect of the present invention provides a game system comprising: an element selection device which is configured to select a part of a plurality of selective elements from among the plurality of selective elements; and a computer programmed to function as a value control device which is configured to control, based on selection by the element selection device, a value for each game element which is displayed in a game image, wherein a plurality of kinds of attributes are set as factors which determine the value of the game element, and a change condition is set for each kind of attribute in order to make a state of each kind of attribute change in relation to the selection by the element selection device, and the computer is programmed to function as the value control device which is provided with an attribute control device configured to control the value of the game element by changing the state of each kind of attribute based on the selection by the element selection device and the change condition set for each kind of attribute.

Another aspect of the present invention provides a method for controlling a game system comprising a computer, the computer controlling a value for each game element displayed in a game image, based on selection of a part of a plurality of selective elements from among the plurality of selective elements by a predetermined element selection device, comprising the steps of: setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

A further aspect of the present invention includes a non-transitory computer readable storage medium storing a computer program for a game system comprising a computer, the computer controlling a value for each game element displayed in a game image, based on selection of a part of a plurality of selective elements from among the plurality of selective elements by a predetermined element selection device, the computer program making the computer execute the steps of: setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

BRIEF EXPLANATION OF DRAWINGS

FIG. 3 is a conceptual diagram for explanation of game progression control of a cultivation game;

DESCRIPTION OF EMBODIMENTS

Figure 1:
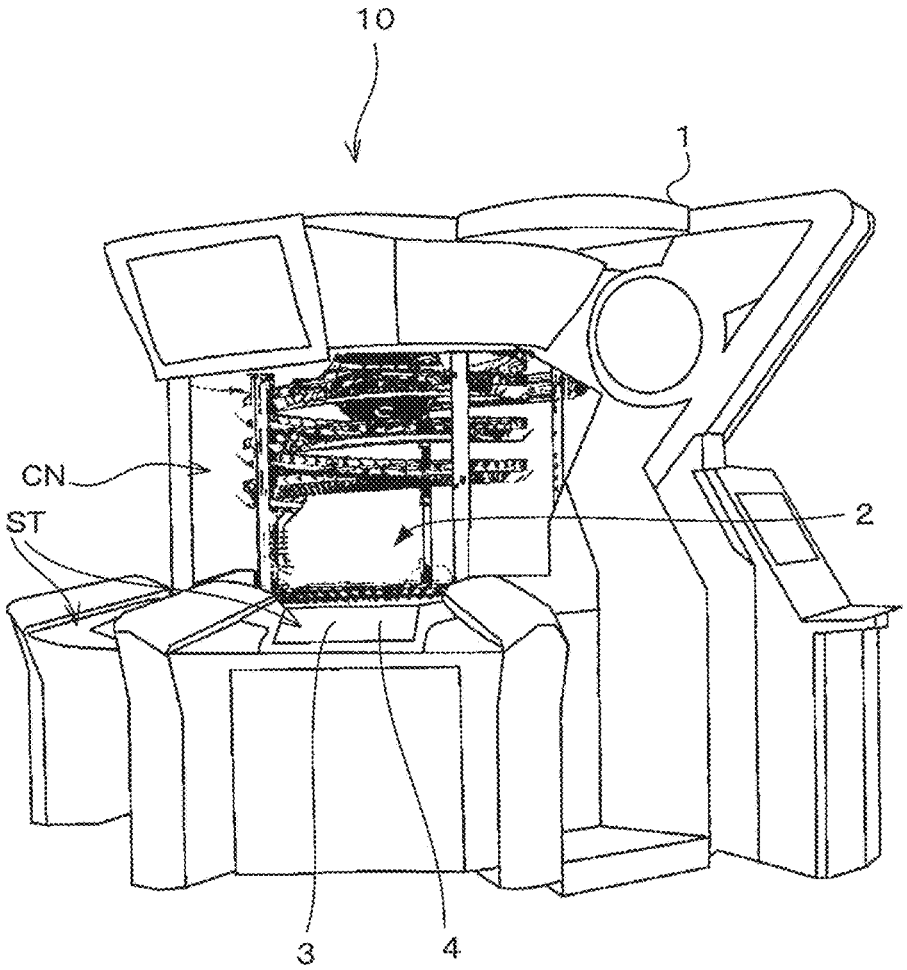
FIG. 1 is an overall view showing a game machine to which a game system according to an embodiment of the present invention is applied.

FIG. 1 is an overall view showing a game machine 1 to which a game system 10 according to an embodiment of the present invention is applied. This game machine 1 is built as a game machine for commercial use (i.e. for business use) that, in exchange for payment of a predetermined playing fee, allows a user to play a game over a range that corresponds to that playing fee. This type of game machine 1 is sometimes termed an arcade game machine. The game machine 1 is installed in a predetermined facility such as a store or the like, with the primary objective of causing a large number of users to play the game repeatedly, thus making a profit.

Figure 2:
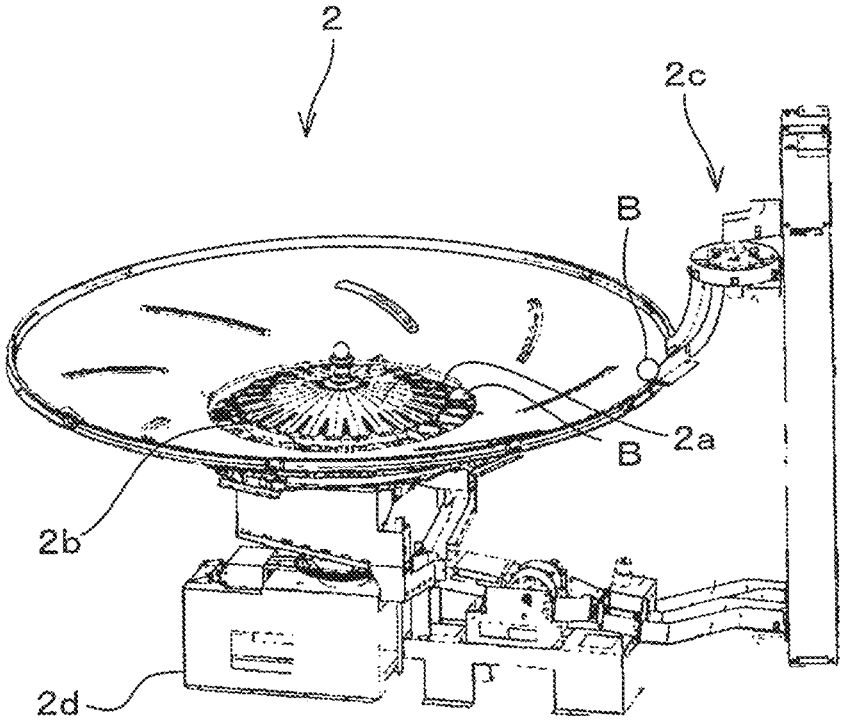
FIG. 2 is a partial enlarged view of main portions of a lottery mechanism.

The game machine 1 comprises a center unit CN and a plurality of station units ST that are arranged to surround this center unit CN. In the center unit CN, a lottery mechanism 2 is provided for selecting any number from a plurality of numbers (as one example, from integers from 1 to 25), so that these selected numbers may serve as a plurality of selective elements. FIG. 2 is an enlarged view of main portions of the lottery mechanism 2. In this lottery mechanism 2, there are provided a rotatable roulette wheel 2*b* that has a plurality of pockets 2*a* one corresponding to each of the plurality of numbers, a ball launching mechanism 2*c* that launches a ball B onto the roulette wheel 2*b*, and a ball collecting mechanism 2*d* that collects the ball B from one of the pockets 2*a*. A ball B is launched from the ball launching mechanism 2*c* onto the roulette wheel 2*b* which is rotating, and this ball B falls into one of the pockets 2*a*. After the game ends, the ball collecting mechanism 2*d* retrieves the ball B from the pocket 2*a*, and supplies it back to the ball launching mechanism 2*c*. This lottery mechanism 2 is a per se known physical lottery mechanism by which the number that corresponds to the pocket 2*a* into which the ball B falls is selected as a result of the lottery, and may be constructed by using per se known technology. Moreover, this lottery mechanism 2 may be realized in various ways other than by means of a roulette system, such as a rotatory lottery machine, an electronic lottery mechanism that employs random numbers, or the like.

A cultivation game that progresses on the basis of the numbers selected by the lottery mechanism 2 can be played upon each of the station units ST. Each of the station units ST is provided with a medal intake slot (not shown in the figures), a display device 3, and a transparent touch panel 4 that is overlaid over the display device 3. The user plays the cultivation game by actuating the touch panel 4 according to the game screen that is displayed upon the display device 3.

FIG. 3 is a conceptual diagram for explanation of game progression control of the cultivation game. The cultivation game is a game in which plants 102 that have been planted in a flower bed 101 displayed upon a display device 3 are cultivated according to numbers selected by the lottery mechanism 2. The flower bed 101 is defined as a total of sixteen cells M11, M12, . . . M43, M44 that are arranged in four rows by four columns (in some cases one of these cells may simply be referred to by the reference symbol M when no specific one of them is intended to be designated), and the plant 102 (corresponding to value of a game element) that is planted in each of the cells M11 through M44 grows and changes color according to the numbers that are selected by the lottery mechanism 2, and a change condition that will be described hereinafter. The plants 102 grow, in order, into sprouts 102*a*, buds 102*b*, and flowers 102*c*, with the plants 102 growing in the cells M11 through M44 respectively being displayed upon the display device 3 in such a manner that their states of growth can be identified. Furthermore, a level (for example in eight stages, from level #0 to level #7) is set for each of the cells M and works as an indicator indicating a dividend to a user. The levels are differentiated by the colors of the buds 102*b* and the colors of the flowers 102*c*. For example, the level may get higher as the color changes through yellow, blue, red, copper, silver, and gold in that order. By looking at the states of cultivation of the plants 102 in the cells M, the user can understand what reward will be given to him/her when the game ends.

With these cells M11 through M44, each set of cells M arranged along in the same row or along the same column (for example, the cells M11 through M14) is considered to form a single group. Due to this, eight groups are formed upon the flower bed 101. It should be understood that, in some cases, these eight groups will be distinguished by being called "line #1" through "line #8". Thus each cell belongs to a total of two lines: a vertical line and a horizontal line. At least one number, each number being a subject of lottery by the lottery mechanism 2, is allocated to each of the lines. One through four numbers are allocated to each line at random by using random numbers, and, when one of these numbers that has been allocated is selected by the lottery mechanism 2, that number is activated. In the following, the fact that one of numbers allocated to each line has been selected by the lottery mechanism 2 will sometimes be expressed as being a "hit". Each number that is allocated to each line in the cultivation game, and information indicating whether or not the hit upon the corresponding number has occurred (for example "0" indicating that no hit has occurred and "1" indicating that the hit has occurred) are linked to the line to which the corresponding number is allocated and recorded in line information data 22. Moreover, the level that is set for each of the cells M is recorded in cell information data 23, and each time the level of a cell M is changed, its record is updated.

Cultivation of the plants 102 is determined according to whether or not the hit state of each line satisfies a change condition. For cultivation of the plants 102, a growth attribute (which corresponds to a "first attribute") in which a plant 102 grows from a seed (soil 101*a*) into a sprout 102*a*, a bud 102*b*, and a flower 102*c*, and a modification attribute (which corresponds to a "second attribute") in which the color of the plant 102 changes, are set, and a change condition is set for each of these attributes. As the change condition for the growth attribute, the condition is set that, with respect to the two lines to which each cell M belongs, the number of lines where the hit has occurred (hereinafter, "the number of hit lines") increases. For example, with respect to each cell M, in a case that a sprout 102*a* is displayed when the number of hit lines is zero, a bud 102*b* is displayed when the number of hit lines becomes one, and a flower 102*c* is displayed when the number of hit lines becomes two (hereinafter sometimes this is referred to as a "cross hit"). Each time the number of hit lines increases, the plant grows by one stage, and the value of the cell M increases.

Moreover, as the change condition for the modification attribute, it is set that, with respect to each of the two lines each cell M belongs to, an allocated number is selected duplicately, that is, a duplicate selection is made. For example, when the hit has occurred upon two numbers of a single line, the change condition for the modification attribute is satisfied, and the level rises by one level from the current level. Moreover, in a case that the hit has occurred upon a third number, the change condition for the modification attribute is also satisfied, and the level rises by one level. Subsequently, each time such a duplicate selection is made, it is determined that the change condition for the modification attribute is satisfied, and then the level rises, so that the value of the cell M increases. In a case that the level rises in the state of the bud 102*b* or of the flower 102*c*, the color changes, thereby the current level of the plant 102 in each cell M can be recognized. The dividend that is given to the user is determined according to the colors of the flowers 102*c* that are blooming in the flower bed 101.

FIGS. 4A through 4D are figures showing examples of game screens of this cultivation game. It should be understood that, although the game screens 100A through 100D shown in FIGS. 4A through 4D are shown as examples of game screens, in some cases one of them may simply be referred to as a game screen 100 when no specific one thereof is intended to be designated. On the game screen 100A of FIG. 4A, there are provided the flower bed 101 described above, number display sections 103 that display the numbers assigned to each line, a dividend display section 104, a lottery state display section 105 that displays the lottery state of the lottery mechanism 2, a credit display section 106 that displays the credit balance of the user such as the number of credits possessed by the user, the number of bets in the game currently being played, the number of credits he/she has won, and so on, and a step display section 107 that displays the remaining steps until a jackpot game is performed.

The user bets some of the credit that he/she possesses as a participation condition to the cultivation game. For example, he/she is allowed to participate in the cultivation game in exchange for expenditure of a predetermined amount of credits. Furthermore, he/she may expend some further credits in order to progress advantageously in the cultivation game. For example it would be acceptable, in exchange for expenditure of a predetermined amount of credits, to arrange to permit the user to plant a sprout 102*a* in a cell M designated by the user, to activate a line designated by the user, or to change the level of a cell M. It would also be possible to arrange to set the level of a cell M according to the credits that the user expends when he/she is allowed to plant a sprout 102*a*. Alternatively, it would be acceptable to arrange to provide this type of advantageous situation without any credit being consumed.

The numbers assigned to the respective lines are recorded in the line information data 22, and the levels of each of the cells M are recorded in the cell information data 23. It should be understood that, in the following explanation, the cultivation game is explained with the cell information data 23 of FIG. 3 in its initial state. Also, in the cell M, in some cases, an apple 107*a* is set and becomes a subject of counting on the step display section 107. The cell M to which the apple 107*a* is set and the numbers of apples 107*a* that are set are determined at random. Alternatively, it would also be acceptable to give the apple 107*a* to a certain cell M in exchange for expenditure of credits. When the cross hit occurs with respect to the two lines of a cell M to which an apple 107*a* has been given, the apple 107*a* can be acquired, and the step of the step display unit 107 is advanced by one. When progress reaches the final step, a jackpot game is performed at the center unit CN.

Figure 4A:
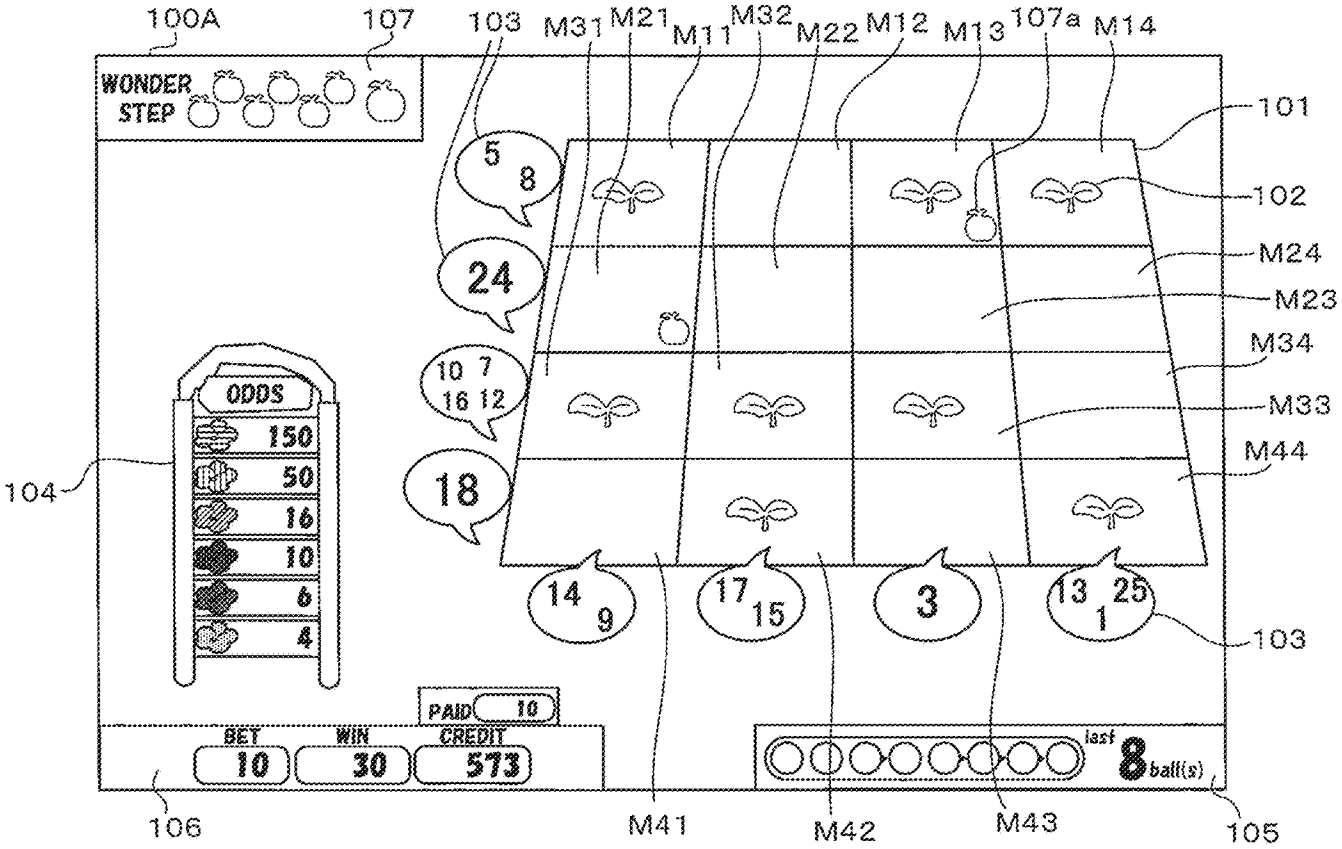
FIG. 4A is a diagram showing an example of a game screen of this cultivation game.
Figure 4B:
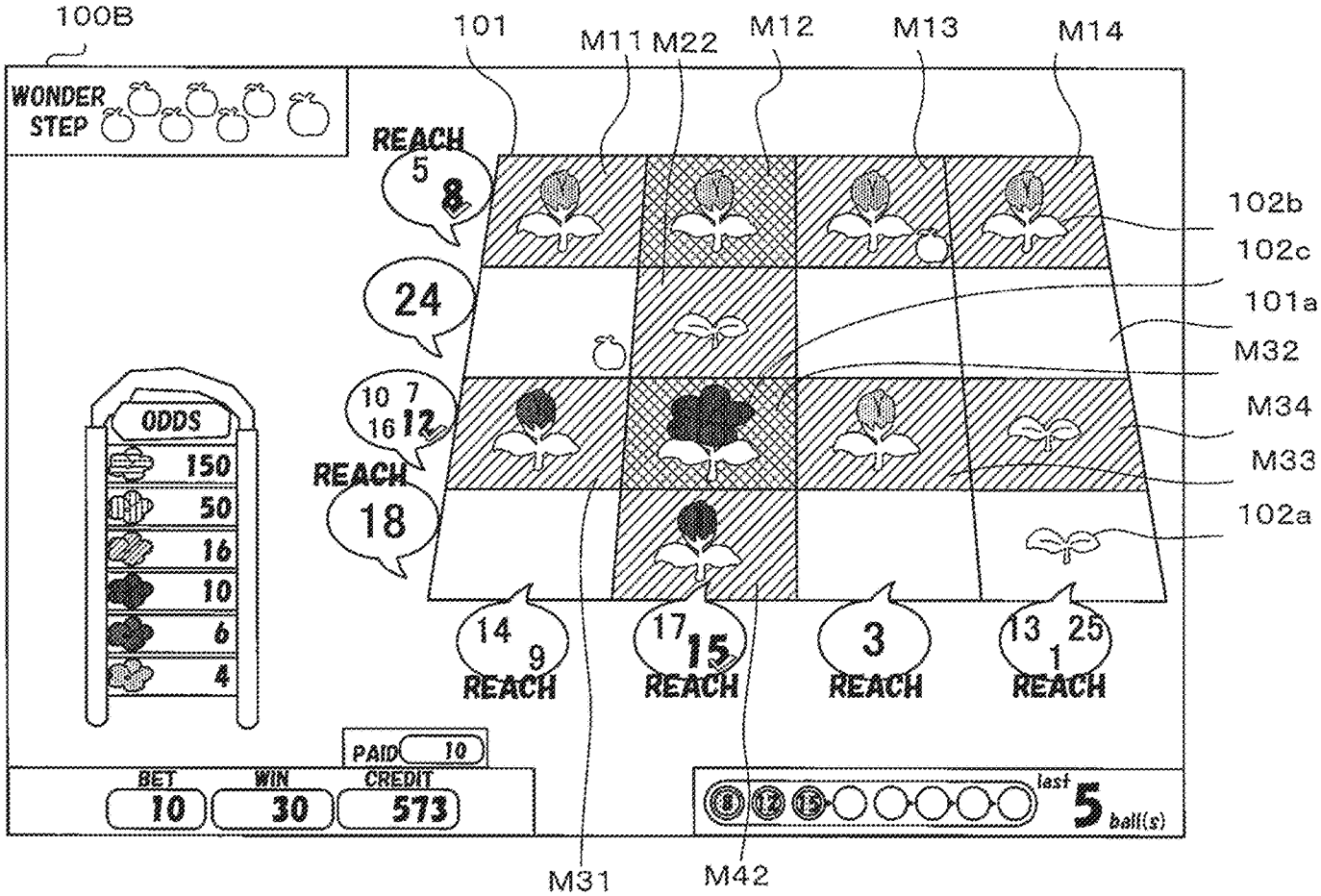
FIG. 4B is a diagram showing an example of a game screen, which is a continuation from the screen of FIG. 4A.

When the cultivation game is started, the lottery mechanism 2 selects a part out of the plurality of numbers. For example, three numbers may be selected in a first lottery, two numbers may be selected in a second lottery, and one number may be selected in each of third through fifth lotteries, so that a total of eight numbers are selected in one time of this cultivation game. It should be understood that the numbers that are selected in one time of the cultivation game are all different from each other: the same number is never selected twice. FIG. 4B shows a continuation of the game screen 100A of FIG. 4A, and is a game screen 100B displayed after the first lottery has been performed. On this game screen 100B, a situation is shown in which the state of the flower bed 101 has changed as a result of the numbers "8", "12", and "15" having been selected by the lottery mechanism 2. Due to "8" in the first line #1 having been selected, the sprouts 102*a* in the cells M11, M13, and M14 have changed to yellow color buds 102*b*. And, due to "12" in line #3 having been selected, the sprouts 102*a* in the cells M31 and M33 have also changed to yellow color buds 102*b*, and moreover the cell M34 changes, from the soil state 101*a* with a seed planted in it, into a sprout 102*a*. Moreover, due to "15" in line #6 having been selected, the cell M22 changes from the soil state 101*a* into a sprout 102*a*, and the sprout 102*a* in the cell M42 changes into a red bud 102*b*. While the change from a sprout 102*a* into a bud 102*b* depends upon the growth attribute, the color of the bud 102*b* depends upon the level of the cell M. In this case the cell M42 is level #4, so the sprout changes into the red bud 102*b*.

Due to the cross hit has occurred at the cells M12 and M32, the cell M12 which was at level #1 changes from the soil state 101*a* into a yellow color bud 102*b*, while the cell M32 which was at level #4 changes from a sprout 102*a* into a red color flower 102*c*. These changes in the flower bed 101 due to this first lottery are changes of state due to the change condition for the growth attribute having been satisfied, and the levels of the cells M do not change. And, due to these changes in the state of the flower bed 101, the word "REACH" is displayed in the number display sections 103 of those lines each containing a cell M that will be changed into a flower 102*c* if one more number is hit.

Figure 4C:
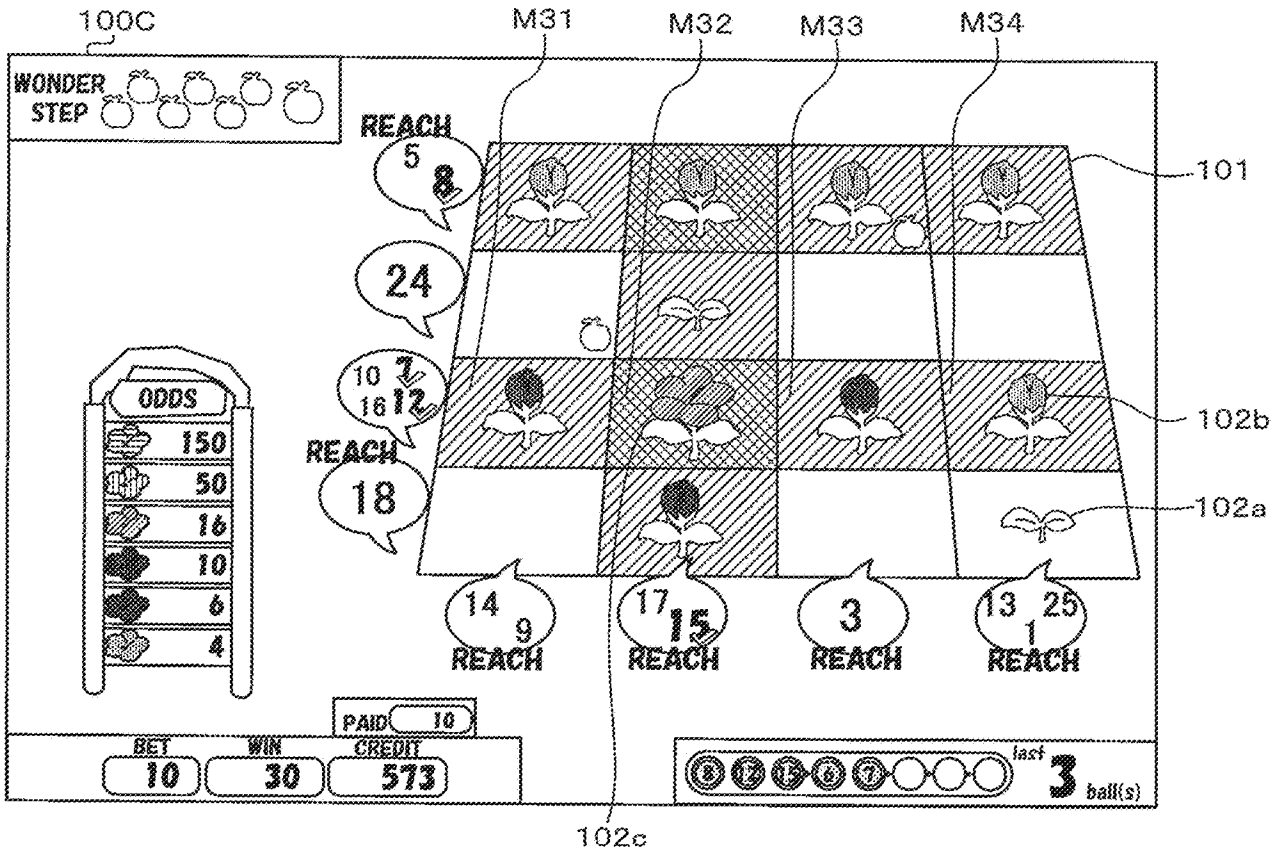
FIG. 4C is a diagram showing an example of a game screen, which is a continuation from the screen of FIG. 4B.

FIG. 4C shows a continuation of the game screen 100B of FIG. 4B, and shows a game screen 100C after the second lottery has been performed. This game screen 100C shows the way in which the state of the flower bed 101 changes as the result of "6" and "7" having been selected by the lottery mechanism 2. Since the number "6" that has been selected is not allocated to any line, accordingly it exerts no influence upon the flower bed 101. However, due to "7" on line #3 having been selected, the change condition for the modification attribute is satisfied for each of the cells M31 through M34 on line #3, so that the level of each of the cells M31 through M34 is increased by one. Because of this, the blue color bud 102*b* in the cell M31 changes to a red color bud 102*b*, the red color flower 102*c* in the cell M32 changes to a copper color flower 102*c*, the yellow color bud 102*b* in the cell M33 changes to a blue color bud 102*b*, and the sprout 102*a* in the cell M34 changes to a yellow color bud 102*b*.

Figure 4D:
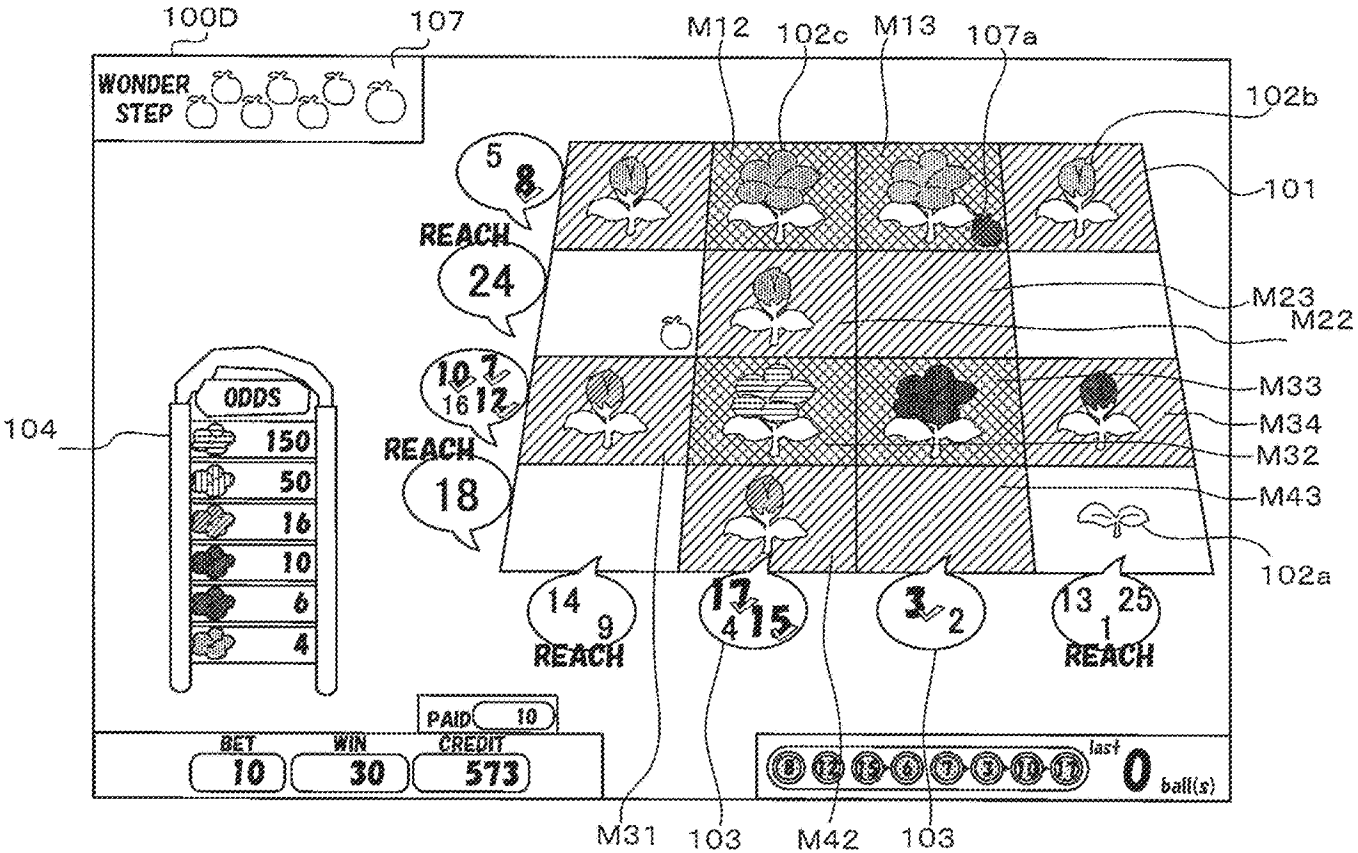
FIG. 4D is a diagram showing an example of a game screen, which is a continuation from the screen of FIG. 4C.

FIG. 4D shows a continuation of the game screen 100C of FIG. 4C, and shows a game screen 100D after the fifth lottery has been performed. This game screen 100D shows the way in which the state of the flower bed 101 changes as the result of "3" having been selected in the third lottery, "10" having been selected in the fourth lottery, and "17" having been selected in the fifth lottery. Due to "3" on line #7 having been selected, the cross hit has occurred at the cell M13, and the yellow color bud 102*b* changes into a yellow color flower 102*c*. And an apple 107*a* associated with the cell M13 is given as a reward. Since the cells M23 and M43 are level #0, accordingly they remain in the soil state 101*a* without alteration, even though the change condition for the growth attribute is satisfied. When all of the numbers displayed upon the number display section 103 of line #7 are selected, a new number ("2" in FIG. 4D) is added to this number display section 103. The numbers that are added are determined at random from among the numbers that have not yet been selected by the lottery mechanism 2, and that are not yet allocated to any line.

Due to "10" on line #3 having been selected, the change condition for the modification attribute is satisfied by line #3, and the level of each of the cells M31 through M34 is increased by one. And, due to this, the red color bud 102*b* in the cell M31 changes into a copper color bud 102*b*, and the yellow color bud 102*b* in the cell M34 changes into a blue color bud 102*b*. Moreover, due to the cell M33 satisfies both of the change conditions of the modification attribute and growth attribute, accordingly the blue color bud 102*b* in the cell M33 changes into a red color flower 102*c*. And, due to "17" on line #6 having been selected, the change condition for the modification attribute of the cells M12 through M42 that belong to line #6 is satisfied, and the level of each of the cells M12 through M42 is increased by one. Because of this, the yellow color bud 102*b* in the cell M12 changes into a yellow color flower 102*c*, the sprout 102*a* in the cell M22 changes into a yellow color bud 102*b*, and the red color bud 102*b* in the cell M42 changes into a copper color bud 102*b*. Moreover, due to the fact that both "10" in line #3 and "17" in line #6 have been selected, the change condition for the modification attribute is satisfied twice, accordingly, the copper color flower 102*c* in the cell M32 changes into a gold color flower 102*c*. Also, since all of the numbers displayed in the number display section 103 have been selected in line #6 as well, accordingly a new number is added.

The reward to be given to the user is determined on the basis of the state of the flower bed 101 at the moment when all of the lotteries have been completed. The game screen 100D of FIG. 4D shows the state of the flower bed 101 when the lottery is completed, and the amount of credits to be paid to the user is determined according to the odds displayed upon the dividend display section 104. Since the yellow color flowers 102*c* are blooming in the cells M12 and M13, accordingly a total of eight credits are added to the reward; 150 credits are added on the basis of the gold color flower 102*c* in the cell M32; and 10 credits are added on the basis of the red color flower in the cell M33. Due to this, 168 credits in total and the apple 107*a* due to the cross hit has occurred at the cell M13 are given to the user as a reward.

Figure 5:
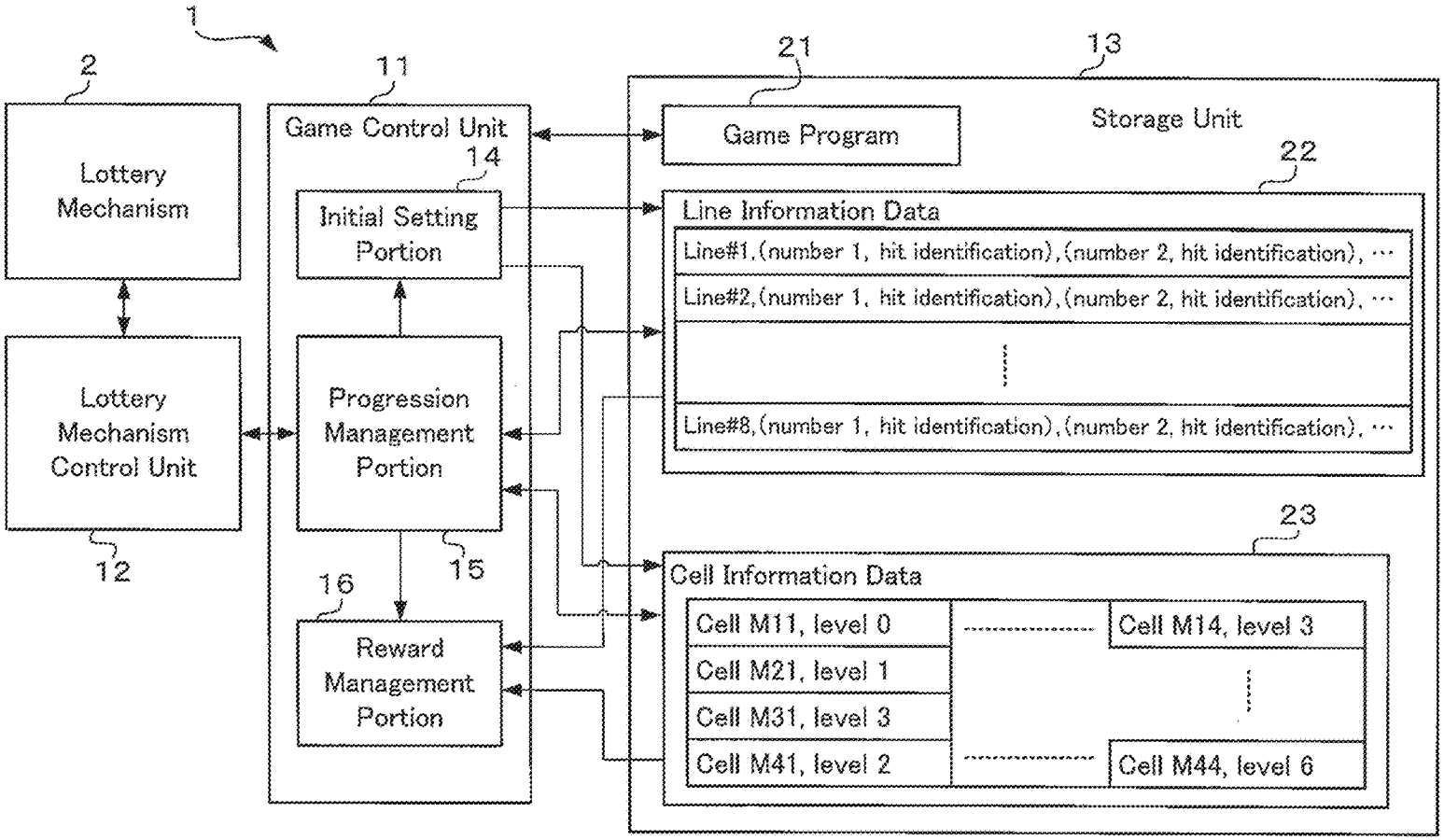
FIG. 5 is a functional block diagram showing a structure of a control system of the game machine.

FIG. 5 is a functional block diagram showing the structure of a control system of the game machine 1. A game control unit 11 that controls the cultivation game, a lottery mechanism control unit 12 that controls the operation of the lottery mechanism 2, and a storage unit 13 are provided to the game machine 1. The game control unit 11 and the lottery mechanism control unit 12 are logical devices that are implemented by a combination of hardware (including a CPU and a memory, which is a device internal thereto) and software of the game machine 1. The storage unit 13 is a device that includes a non-volatile storage medium such as a magnetic storage medium, an optical storage medium, an EEPROM, or the like. A game program 21 for executing the game upon the game machine 1, the line information data 22, and the cell information data 23 are stored in the storage unit 13. It should be understood that specific examples of the line information data 22 and the cell information data 23 are shown in FIG. 3. In addition, the storage unit 13 stores play data for recording data necessary for the user to continue the game such as game results and so on, and various kinds of data necessary for executing the game.

By the game control unit 11 reading in and executing the game program 21 stored in the storage unit 13, an initial setting portion 14 that sets the line information data 22 and the cell information data 23 before the cultivation game starts, a progression management portion 15 that manages the progression of the cultivation game, and a reward management portion 16 that manages rewards to be given to the user according to the game result after the cultivation game ends, are provided in the interior of the game control unit 11 as logical devices. In addition, the lottery mechanism control unit 12 controls the operation of the lottery mechanism 2, and also notifies the lottery results to the progression management unit 15.

Figure 6:
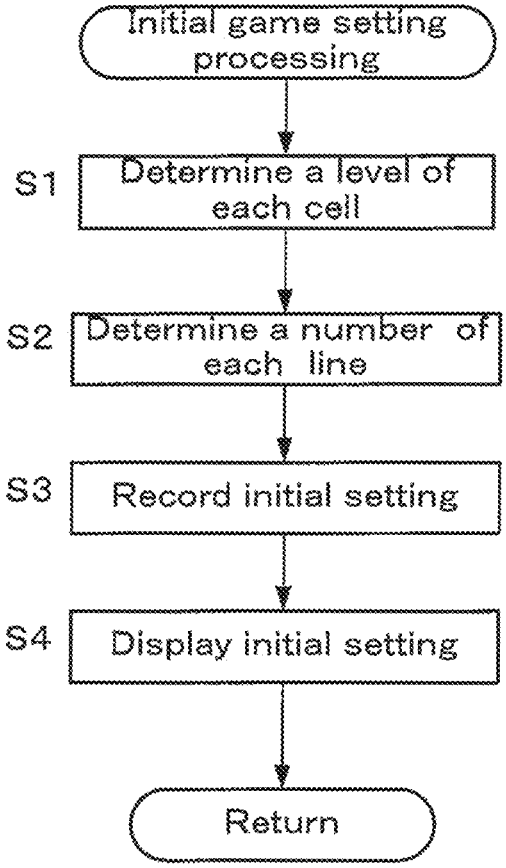
FIG. 6 is a flow chart for explanation of initial game setting processing executed by a game control unit of the game machine.

FIG. 6 is a flow chart for explanation of initial game setting processing executed by the game control unit 11 of the game machine 1. This initial game setting processing sets the line information data 22 and the cell information data 23 for the start of the cultivation game. The game control unit 11 determines levels that are set for the cells M11 through M44 respectively (in step S1). Any level may be set for each of the cells M, from level #0 to level #7. As initial setting, the initial level of each cell M is determined at random, but it would be acceptable to set an upper limit for the initially set level. Moreover, it would be acceptable to arrange for a level specified by a user to be set for a cell M specified by the user. It would also be acceptable to arrange to permit a user to specify one or more initial levels, in exchange for expenditure of credits.

Next, the game control unit 11 determines numbers to be allocated to each line (in step S2). As mentioned above, the numbers that are to be allocated to the lines are determined at random by using random numbers, but it would also be acceptable to allow the user to select a specific line to which a specific number is to be allocated. As an example of such selection, a specific number may be presented to the user, and he/she may be invited to select a line to which that number is to be allocated. Alternatively, it would also be acceptable to provide a structure in which numbers that are to be allocated to each line are displayed upon its number display section 103, and the user is enabled to reallocate numbers to the line until he/she is satisfied and confirms his/her choice.

The game control unit 11 records the initial settings determined in the steps S1 and S2 in the line information data 22 and in the cell information data 23 (in step S3). And then the game control unit 11 displays plants 102 in the flower bed 101 on the basis of the line information data 22 and the cell information data 23 and displays the numbers that have been allocated in the number display sections 103 (in step S4), and then the current processing terminates. According to the processing described above, before the start of the cultivation game, the initial settings necessary for progression of the game are determined (in the steps S1 and S2) and are recorded in the line information data 22 and in the cell information data 23 (in the step S23), and are displayed upon the game screen 100 (in the step S4). And, by adjusting the line information data 22 and the cell information data 23, it is possible to adjust the amount of credits that are given to the user as a reward.

Figure 7:
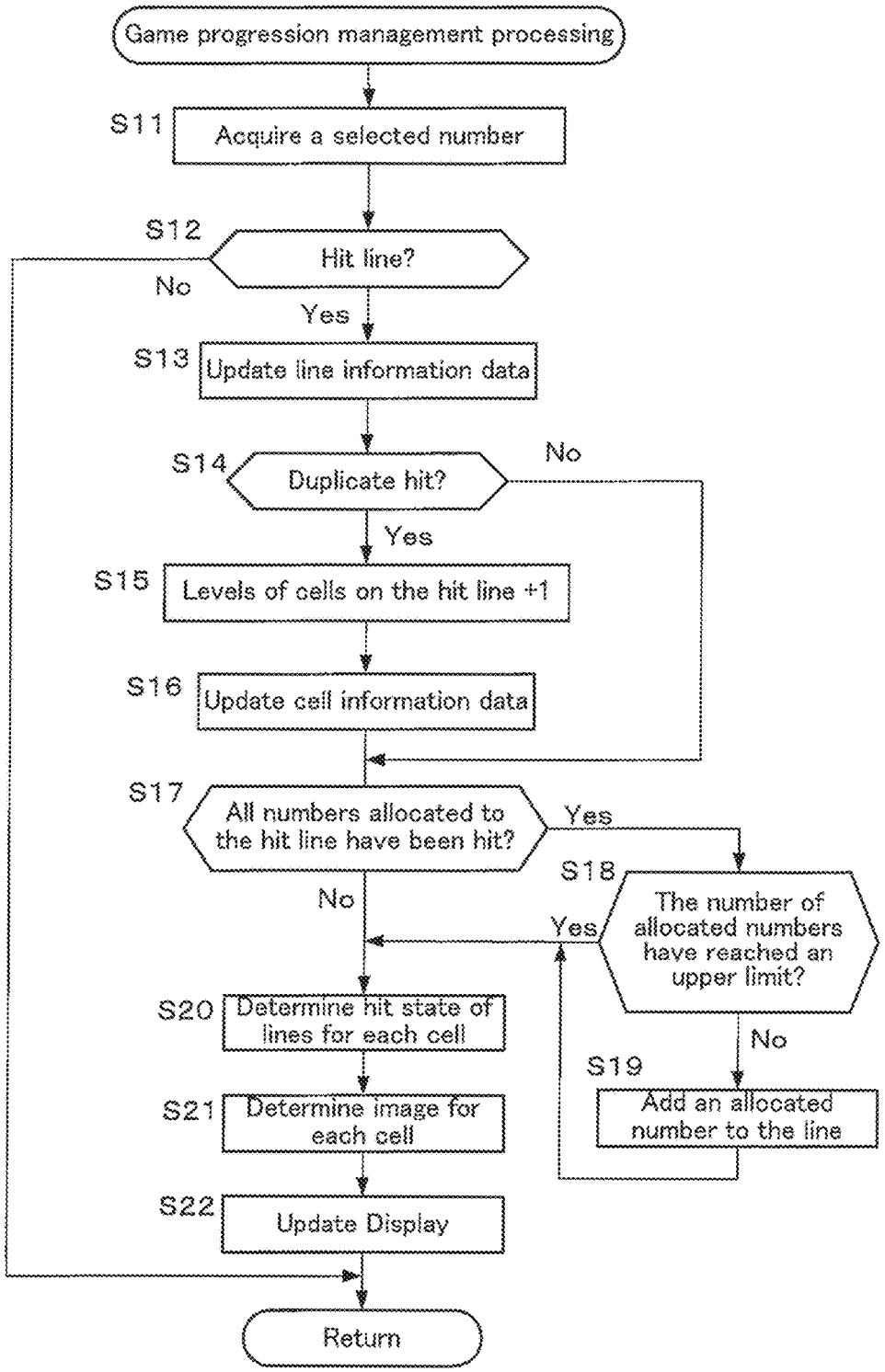
FIG. 7 is a flow chart for explanation of game progression management processing executed by the game control unit of the game machine.

FIG. 7 is a flow chart for explanation of game progression management processing executed by the game control unit 11 of the game machine 1. This game progression management processing is processing for controlling the progression of the cultivation game, and is executed for each number which has been selected by the lottery mechanism 2. The game control unit 11 acquires the number selected by the lottery mechanism 2 (in step S11), and determines whether or not there is a line where the hit has occurred (hereinafter, the hit line) (in step S12). The number that has been selected and the line information data 22 are compared together, and whether or not there is a hit line is determined. In a case that there is no hit line, then the game control unit terminates the current processing. In a case that there is a hit line, then the game control unit 11 updates the line information data 22 (in step S13). The game control unit 11 changes the hit identification of the number recorded in the line information data 22 from "0" to "1", thus meaning that a hit has occurred, and thereby performs updating.

The game control unit 11 determines (in step S14) whether or not the current hit is a duplicate hit (this hit makes the duplicate selection) with respect to the line to which the selected number is allocated. The second and any later hit on a single line is determined as the duplicate hit. The duplicate hit is set as the change condition for the modification attribute. In a case of the duplicate hit, the game control unit 11 raises the level of each cell M belonging to the hit line by one (in step S15), and updates the cell information data 23 (in step S16). But in a case of not the duplicate hit, the game control unit 11 skips the processing of the steps S15 and S16.

The game control unit 11 then determines (in step S17) with respect to the hit line, whether or not all of the numbers allocated to the line have been hit. In a case that all the numbers have been hit, then the game control unit 11 determines (in step S18) whether or not the number of the numbers allocated to that line has reached an upper limit. In a case that this upper limit has not been reached, then the game control unit 11 allocates a new number to the corresponding line (in step S19). In a case that the upper limit has not been reached, then the game control unit 11 skips the processing of this step S19. In this case, the cultivation game is continued as it is, with no new number being allocated to that line.

By referring to the line information data 22, for each cell M belonging to the hit line, the game control unit 11 determines (in step S20) the hit state of lines which the cell M belongs to. In a case that the hit has occurred to a line that has not yet been hit, then the change condition for the growth attribute is satisfied. The game control unit 11 then determines (in step S21) the plants 102 to be displayed in each cell M of the flower bed 101 on the basis of the results of determination in the step S20 and the cell information data 23. As one example, the plants 102 to be displayed may be determined by reference to the table in FIG. 3 which is the changes of a plant by cultivation. And then the game control unit 11 updates the display on the game screen 100 (in step S22), and terminates the current processing. Updating of the display on the game screen 100 includes changing the state of each of the cells M in the flower bed 101, showing with effect the numbers that have been hit in the number display sections 103, showing with addition effect new numbers, and so on.

According to the processing described above, in a case that the number that has been selected by the lottery mechanism 2 makes a hit on a certain line (the steps S11 and S12), and if the change condition for the modification attribute is satisfied (the step S14), then the level of each of the cells M in the corresponding line is increased by one (the step S15). Furthermore, it is determined whether or not the change condition for the growth attribute is satisfied (the step S20). And the plants to be displayed in the cells M are determined respectively on the basis of the change condition for the modification attribute and the change condition for the growth attribute (the step S21), and the display on the game screen 100 is updated (the step S22). Thus it becomes possible to present a game which is allowed to progress in variable ways, since the plants 102 that are displayed in each of the cells M change according to the change conditions for the growth attribute and for the modification attribute, on the basis of the selection of numbers by the lottery mechanism 2. For example, it becomes possible to present a game which is allowed to progress in variable ways, such as one in which the game ends in a state of the bud 102*b* even if the level of the cell M is high so that the user can anticipate a high value reward, or one in which, even though giving a reward is permitted due to the cross hit, the levels of the cells M are low so that the user cannot anticipate a high value reward. The value of each of the cells M changes according to the change conditions for each of the two attributes, but it is possible for the user simply and easily to recognize the approximate reward that he/she will receive, due to the display of the plants 102 which change according to the states of their attributes.

Figure 8:
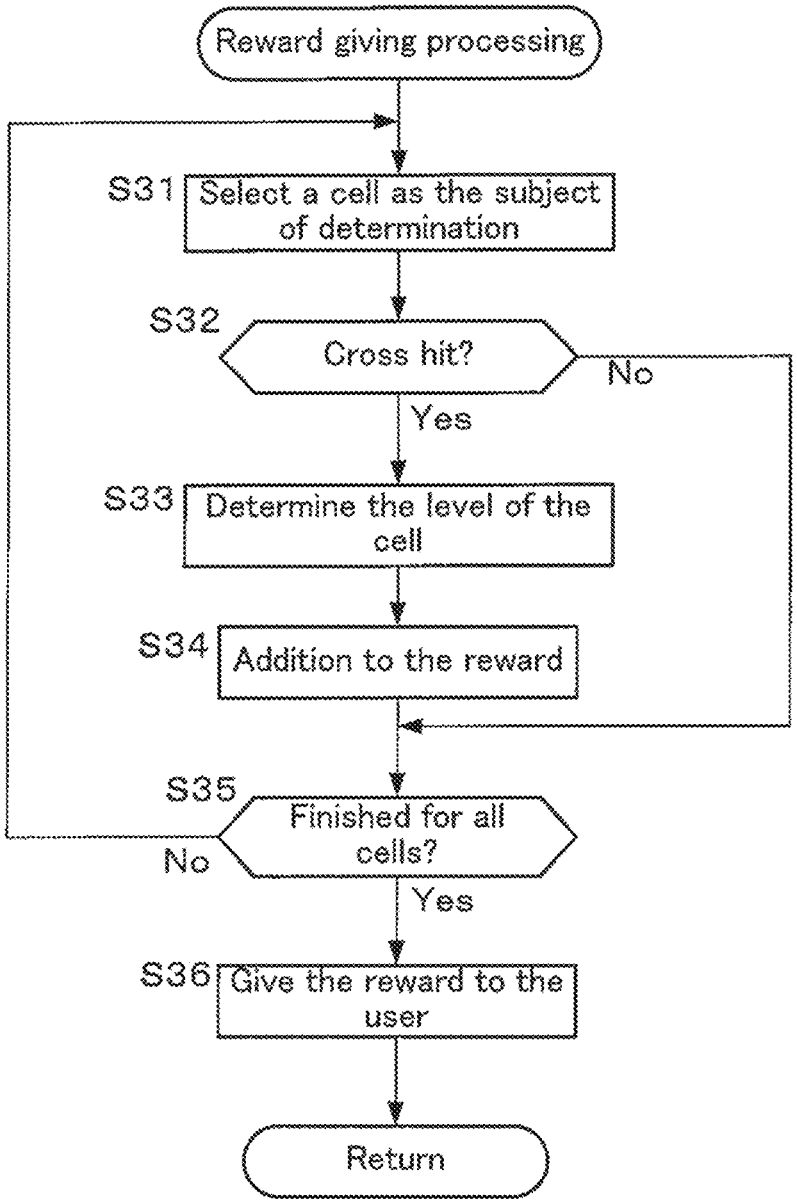
FIG. 8 is a flow chart for explanation of reward giving processing executed by the game control unit of the game machine.

FIG. 8 is a flow chart for explanation of reward giving processing executed by the game control unit 11 of the game machine 1. This reward giving processing is processing in which a reward for the user after the cultivation game has ended is determined, and this reward is given to the user. The game control unit 11 selects a cell M that is to be the subject of determination (in step S31), and determines whether or not the cross hit has occurred at that cell M (in step S32). In a case that the cross hit has occurred, then the game control unit 11 determines its level (in step S33). In a case that the level is #2 or higher, then a flower 102*c* blooms, and this becomes a subject of giving a reward. Thus, the game control unit 11 adds a reward generated by this cell M to the reward for the user (in step S34). Also, in a case that an apple 107*a* has been set to this cell M, then the game control unit 11 adds this apple 107*a* to the reward for the user.

The game control unit 11 then determines whether or not the rewards generated by all of the cells M have been added to the reward for the user (in step S35), and returns the flow of control to the step S1 so as to continue this processing in a case that there is still a remaining cell M. In a case that this processing has been completed for all of the cells M, then the game control unit 11 gives the reward to the user (in step S36), and then the current processing routine terminates. At this time, in a case that the result of adding together the rewards for all of the cells M is that there is no reward for the user, there is no reward to be given to the user by the cultivation game. Moreover, the game control unit 11 displays the reward for the user upon the display device 3 in a predetermined manner as the game result, along with predetermined effects.

According to the processing described above, after the end of the cultivation game, the rewards generated by all of the cells M of the flower bed 101 are added to the reward for the user (in the steps S31 through S35), and the reward generated by this cultivation game is given to the user (in the step S36). Even though the user may anticipate a high reward due to the display of the buds 102*b*, it is possible to suppress the reward by imposing the restriction that the change condition for the growth attribute becomes established.

The present invention is not to be considered as being limited to the embodiment described above, and could be implemented in various different ways. For example, the present invention is not limited to the example explained in the above embodiment, in which, as the selection of some numbers from a plurality of numbers, the lottery mechanism 2 selects a total of eight numbers in three lotteries. Thus, for example, it would also be acceptable to arrange for all of the numbers that are to be selected in the cultivation game to be selected in a single lottery; or it would also be acceptable for a single number to be selected in a single lottery. The method of lottery may be changed as appropriate, provided that the appropriate total number of numbers required for the cultivation game are selected. Moreover, the element selection device is not limited to being a physical or electronic lottery mechanism. For example, it would be acceptable for numbers to be selected by playing another game that is provided within the game machine 1, or by playing another game that is provided by another game machine that is capable of mutual communication with this game machine 1 via a network. Alternatively, it would also be possible for these numbers to be numbers that are inputted from the exterior, such as numbers that are announced at an event or numbers that are designated by other users or the like. Numbers of this type are inputted via an input device, and are acquired as selected numbers by the game control unit 11 from the input device. Moreover, the subjects of selection are not limited to being numbers. These subjects of selection are not to be considered as being particularly limited, provided that they can be mutually distinguished from one another by color, symbol, pattern, or the like. Furthermore, the way in which the selective elements are selected is not limited to being via the use of a lottery device; the selective elements may be selected in any manner, provided that at least a single selective element is selected from a plurality of selective elements.

Figure 9:
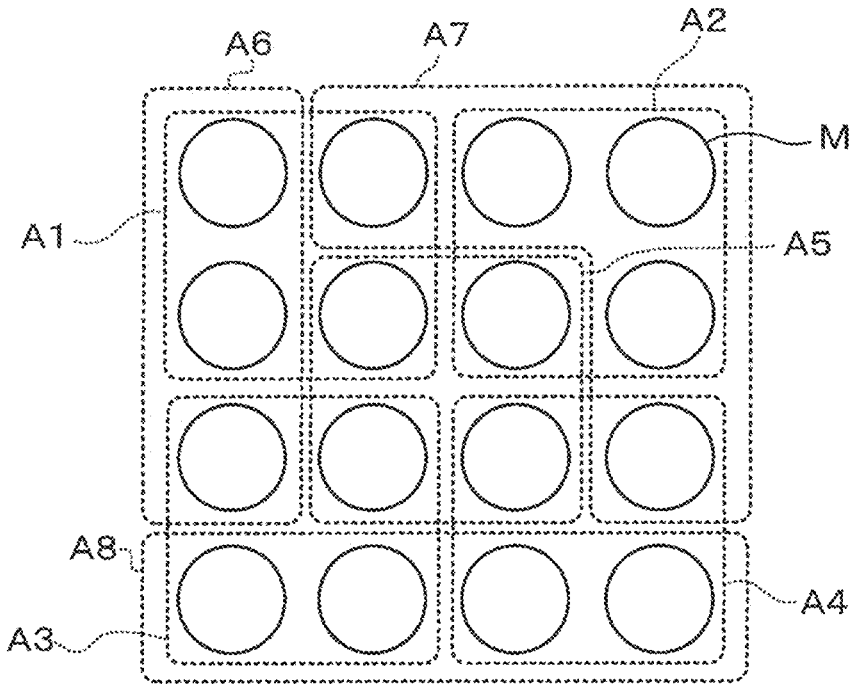
FIG. 9 is a diagram for explanation of a variation of a determination subject group.

In the embodiment described above, the plurality of cells M11 through M44 were explained as being a plurality of game elements, but any appearance would be acceptable, provided that it is possible to distinguish them from each another, and recognize each of them as a game unit whose state can change. For example, even if the appearance is a character (a game character, an animal, fish, and so on), or an item (a weapon, jewelry, food, and so on), or terrain (sea, a mountain, a country, a house, a castle, and so on) or the like, it would be possible to make changes to its state (i.e. changes to colors, changes to effects, changes to shapes, and so on) such as those in the cultivation game described above, The display device 3 may be controlled so as to display images upon the game screen according to change of the state. Moreover, although each of the lines #1 through #8 was explained as the determination subject group, the determination subject group is not limited to be a plurality of cells M that are lined up along one direction. For example it would also be acceptable, as shown in FIG. 9, to arrange to subdivide the plurality of cells M into a plurality of regions A1 through A8, and to link at least a single number to each of these regions A1 through A8. The cells M are shared out so that each of them belongs to two of these regions. Each determination subject group may be set so that each game element belongs to a plurality of determination subject groups. It is not necessary for each game element to be aligned in the vertical or horizontal direction; they may be arranged at random, and moreover the determination subject group may be set with some number of cells as subjects.

Moreover while, in the embodiment described above, the explanation postulated the plurality of cells M11 through M44 which were arranged in four rows and four columns along two axes, vertical and horizontal, this should not be considered as being limitative. For example, it would be acceptable to arrange for cells to be lined up three dimensionally in three dimensional space defined by three axes. In this case, determination subject groups are set for each group of cells lined up along the same direction (i.e. along the X axis, the Y axis, or the Z axis), and each cell belongs to three determination subject groups. Alternatively, it may be arranged to lay down hexagonal cells without any gaps between them, and for adjacent cells to cross in three directions. In this case as well, the determination subject groups are set for each group of cells that are lined up along the same direction, and each cell belongs to three determination subject groups. In this manner, even in the case in which the determination subject groups of each cell are constituted by groups of cells being lined up along three directions (and four or more directions are also possible), this is to be considered as being included within the technical scope of the present invention, provided that groups of cells are present that are lined up along at least two directions.

While, in the embodiment described above, the growth attribute and the modification attribute were explained as attributes of a plurality of kinds, this should not be considered as being limitative of the present invention. It would also be acceptable to arrange newly to add a third attribute, and to set a condition for change of that third attribute. For example, as such a third attribute, it would be possible to set an increase attribute according to which the number of plants 102 planted in a specified cell M increases, and to arrange for the number of plants 102 that are planted to increase to two, when a change condition that is set (for example, that a specified number is selected by the lottery mechanism 2) is satisfied. In this case, it would be acceptable to increase the reward according to increase in the number of plants 102. Moreover, the combination of attributes and change conditions is also not to be considered as being limited to the combination in the embodiment described above. For example, it would be acceptable for the condition that the number of hit lines with respect to each cell M increase, which was explained as the change condition of the growth attribute, to be set as the change condition of the modification attribute; and, conversely, it would also be acceptable for the change condition of the modification attribute to be set as the change condition of the growth attribute. In a case that the number of determination subject groups to which each cell M belongs is insufficient with respect to the growth attribute, then one or more additional determination subject groups shown in FIG. 9 may be added. Appropriate changes may be made in each attribute and in its change condition. Moreover, since a single cell M belongs to a plurality of determination subject groups, accordingly it becomes easier to set a plurality of change conditions, and it is possible to change the states of a plurality kinds of attributes. Even in an embodiment in which a new attribute is set in addition to the first attribute and the second attribute, provided that the first attribute and the second attribute are included, the embodiment is considered to be included within the technical scope of the present invention. In addition, in the embodiment described above, the number that is allocated to each line is set each time the cultivation game is executed, but this is not to be considered as being limitative; it would also be acceptable for the number allocated to each line to be fixed. In such a case, the change conditions are fixed each time the cultivation game is executed. Alternatively, it would also be acceptable to arrange to change the numbers that are allocated to each line at predetermined intervals (for example, every week or the like).

In the embodiment described above an example has been explained in which, when the change condition for each attribute is satisfied, the state of the corresponding attribute is changed and the value of each cell M is increased, but this is not to be considered as being limitative of the present invention. For example, it would be possible to lower the value of each cell M having a corresponding attribute. In concrete terms, it will be acceptable to set some of numbers allocated to each cell M as being numbers that lower the values of the cell M, and, in a case that the change condition for one of the attributes is satisfied when the set number is selected, to change the state of the corresponding attribute in the direction to lower its value. Alternatively, in a case that a number that is not allocated to any line is selected (in concrete terms, a case that in the second lottery "6" has been selected in the situation of the game screen 100C of FIG. 4C), then it would be acceptable to arrange to change the state of one of the attributes of any one of the cells M in the direction to lower its value. Moreover, a condition may be added to lower its value; for example, it would be possible to lower the value of a cell M in a case that no number has been selected successively more than once (for example, twice). It would be acceptable to arrange to specify two or more cells M as cells M whose values are to be lowered; or it would also be possible to specify the cell M whose value is the highest as a cell M whose values is to be lowered. In this case, after the negative determination in the step S12 of the flow chart of FIG. 7, it would be sufficient to supplement processing to change the state of one of the attributes of each of appropriate cells M in the direction to lower its value.

In the embodiment described above, the amount of credits corresponding to the value of each of the cells M was given to the user as a reward, but this is not intended to be limitative of the present invention. For example, it would be acceptable for items or game benefits that can be used in games that are different from this cultivation game to be used as rewards. In a case that weapon items are to be given as rewards, then it will be sufficient to change the grade of the weapon according to the value of each cell M. Game benefits such as character reinforcement or opening of specific stages may also be changed in a similar manner. In such a case, this cultivation game may be provided as a game that can be played within other different games. Moreover, it would be acceptable to arrange to display images of items or the like to be supplied on each of the cells M of the game screen.

In the embodiment described above, all of the cells M11 through M44, which were the plurality of game elements displayed upon the game screen 100, were objects of control by the value control device which performs control on the basis of the results of selection by the element selection device. However, it would also be acceptable to arrange for the objects of control by the value control device to be only some of the game elements, among the plurality of game elements that are displayed upon the game screen 100. For example, it would be acceptable to make the cell M22, the cell M23, the cell M31, and the cell M32 be the objects of control by the value control device, and to change the values in the cells M11 through M14, the cell M21, the cell M24, the cell M33, the cell M34, and the cells M41 through M44 with some other devices. For example, such another device may be configured to perform changes of those values without depending upon selection by the element selection device, on the basis of the results of a game such as a quiz game or an action game or the like; or may be configured to change the values based upon the frequency of game-play by the user. Alternatively, it may also be acceptable to depend upon the results of selection by the element selection device. For example, such another device may be configured to link only a single number with each of the cells M, as in a typical bingo game, and to change the values by determining whether each cell M is valid or invalid according to the numbers that are selected. It is enough that the number of game elements that are to be objects of control is one or more, and the value control device may control the value of at least a single game element on the basis of selection by the element selection device.

The followings are various embodiments of the present invention derived from the embodiments and variations described above.

One embodiment as one aspect of the present invention is a game system comprising: an element selection device which is configured to select a part of a plurality of selective elements from among the plurality of selective elements; and a computer programmed to function as a value control device which is configured to control, based on selection by the element selection device, a value for each game element which is displayed in a game image, wherein a plurality of kinds of attributes are set as factors which determine the value of the game element, and a change condition is set for each kind of attribute in order to make a state of each kind of attribute change in relation to the selection by the element selection device, and the computer is programmed to function as the value control device which is provided with an attribute control device configured to control the value of the game element by changing the state of each kind of attribute based on the selection by the element selection device and the change condition set for each kind of attribute.

One embodiment as another aspect of the present invention is a method for controlling a game system comprising a computer, the computer controlling a value for each game element displayed in a game image, based on selection of a part of a plurality of selective elements from among the plurality of selective elements by a predetermined element selection device, comprising the steps of: setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

One embodiment as further aspect of the present invention is a non-transitory computer readable storage medium storing a computer program for a game system comprising a computer, the computer controlling a value for each game element displayed in a game image, based on selection of a part of a plurality of selective elements from among the plurality of selective elements by a predetermined element selection device, the computer program making the computer execute the steps of: setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

According to the present invention, the value of the game element is controlled according to the change condition for each of the plurality of kinds of attributes, based on the selection of a number by the element selection device.

By using the computer readable storage medium of the present invention, if the computer program stored therein is installed to a computer and executed, thereby, it is possible to realize the game system of the present invention through the computer. The non-transitory computer readable storage medium may be a CD-ROM or the like.

In the above aspect of the present invention, the attribute control device may be configured to determine whether or not the change condition for each kind of attribute has been satisfied depending on the selection by the element selection device, and change the state of each kind of attribute, the kind of attribute corresponding to the change condition which has been satisfied, so that the value increases. In this embodiment, the computer may be further programmed to function as a reward giving device which is configured to give to a user a reward according to the value of the game element at a moment when the selection of the selective elements by the element selection device has reached a predetermined state.

In the above aspect of the present invention, a plurality of game elements may be provided and a plurality of determination subject groups may be set so that each of the plurality of game elements belongs to at least two of the plurality of determination subject groups, and a first attribute and a second attribute may be set as the plurality kind of attributes, wherein the value control device may be configured to selectively associate at least one of the plurality of selective elements with each of the plurality of determination subject groups, and the attribute control device is configured to comprise: a first determination device which is configured to, with respect to each of the determination subject groups, when any one of the selective elements associated with the determination subject group is selected by the element selection device, determine the determination subject group as a selected one, a first state control device which is configured to, with respect to each of the plurality of game elements, each time when the number of determination subject groups determined as the selected ones increases, determine that the change condition for the first attribute with respect to the game element is satisfied and change a state of the first attribute with respect to the game element, a second determination device which is configured to determine, with respect to each of the game elements, whether or not a selective element associated with a same determination subject group which the game element belongs to has been selected duplicately, and a second state control device which is configured to, with respect to each of the plurality of determination subject groups which each game element belongs to, each time when a number of times that the second determination device has determined that the selective element has been selected duplicately, determine that the change condition for the second attribute with respect to the game element and change a state of the second attribute with respect to the game element. According to this embodiment, each of the states of the first attribute and the second attribute changes according to the change condition for each attribute, which is different from each other.

In the above embodiment, the plurality of game elements may be displayed so as to be arranged in a plurality of directions in the game image, and each of the plurality of determination subject groups may be set for each group formed by the game elements arranged in one of the plurality of directions, so that each of the plurality of game elements may belong to at least one determination subject group set for each of the plurality of directions. Further, the plurality of game elements may be displayed so as to be arranged in two directions, so that each game element may belong to a first determination subject group corresponding to a first direction and a second determination subject group corresponding to a second direction.

In the above embodiment, the value control device may be configured to further comprise a correlation setting device configured to set a correlation between each of the plurality of determination subject groups and the plurality of selective elements. Further, the correlation setting device may be configured to, when the first determination device has determined that the determination subject group is the selected one, add a selective element which should be associated with the determination subject group.

In the above embodiment, the computer may be further programmed to function as a reward giving device configured to, at a moment when the selection of selective elements by the element selection device has reached a predetermined state, give a reward to a user for each game element where one attitude within the first attribute and the second attribute has reached a predetermined criterion value, the reward according to a state of another attitude within the first attribute and the second attribute of the game element.

In the above embodiment, the computer may be further programmed to function as a display control device configured to display, with respect to each determination subject group, a selective element identified image in association with the determination subject group in the game image in order to allow a user to recognize the selective elements associated with the determination subject element, and also display an attribute setting state image with respect to each game element in the game image so as to discriminate a state for each attribute of the game element in order to allow the user recognize a state of each of the first attribute and the second attribute with respect to the game element.

What is claimed is:

1. A game system comprising: an element selection device which is configured to select a part of a plurality of selective elements from among the plurality of selective elements; and a computer programmed to function as a value control device which is configured to control, based on selection by the element selection device, a value for each game element which is displayed in a game image, wherein a plurality of kinds of attributes are set as factors which determine the value of the game element, and a change condition is set for each kind of attribute in order to make a state of each kind of attribute change in relation to the selection by the element selection device, and the computer is programmed to function as the value control device which is provided with an attribute control device configured to control the value of the game element by changing the state of each kind of attribute based on the selection by the element selection device and the change condition set for each kind of attribute.

2. The game system according to claim 1, wherein the attribute control device is configured to determine whether or not the change condition for each kind of attribute has been satisfied depending on the selection by the element selection device, and change the state of each kind of attribute, the kind of attribute corresponding to the change condition which has been satisfied, so that the value increases.

3. The game system according to claim 2, wherein the computer is further programmed to function as a reward giving device which is configured to give to a user a reward according to the value of the game element at a moment when the selection of the selective elements by the element selection device has reached a predetermined state.

4. The game system according to claim 1, wherein a plurality of game elements are provided and a plurality of determination subject groups are set so that each of the plurality of game elements belongs to at least two of the plurality of determination subject groups, and a first attribute and a second attribute are set as the plurality kind of attributes, wherein the value control device is configured to selectively associate at least one of the plurality of selective elements with each of the plurality of determination subject groups, and the attribute control device is configured to comprise:

a first determination device which is configured to, with respect to each of the determination subject groups, when any one of the selective elements associated with the determination subject group is selected by the element selection device, determine the determination subject group as a selected one, a first state control device which is configured to, with respect to each of the plurality of game elements, each time when the number of determination subject groups determined as the selected ones increases, determine that the change condition for the first attribute with respect to the game element is satisfied and change a state of the first attribute with respect to the game element, a second determination device which is configured to determine, with respect to each of the game elements, whether or not a selective element associated with a same determination subject group which the game element belongs to has been selected duplicately, and a second state control device which is configured to, with respect to each of the plurality of determination subject groups which each game element belongs to, each time when a number of times that the second determination device has determined that the selective element has been selected duplicately, determine that the change condition for the second attribute with respect to the game element and change a state of the second attribute with respect to the game element.

5. The game system according to claim 4, wherein the plurality of game elements are displayed so as to be arranged in a plurality of directions in the game image, and each of the plurality of determination subject groups is set for each group formed by the game elements arranged in one of the plurality of directions, so that each of the plurality of game elements belongs to at least one determination subject group set for each of the plurality of directions.

6. The game system according to claim 5, wherein the plurality of game elements are displayed so as to be arranged in two directions, and each game element belongs to a first determination subject group corresponding to a first direction and a second determination subject group corresponding to a second direction.

7. The game system according to claim 4, wherein the value control device is configured to further comprise a correlation setting device configured to set a correlation between each of the plurality of determination subject groups and the plurality of selective elements.

8. The game system according to claim 7, wherein the correlation setting device is configured to, when the first determination device has determined that the determination subject group is the selected one, add a selective element which should be associated with the determination subject group.

9. The game system according to claim 4, wherein the computer is further programmed to function as a reward giving device configured to, at a moment when the selection of selective elements by the element selection device has reached a predetermined state, give a reward to a user for each game element where one attitude within the first attribute and the second attribute has reached a predetermined criterion value, the reward according to a state of another attitude within the first attribute and the second attribute of the game element.

10. The game system according to claim 4, wherein the computer is further programmed to function as a display control device configured to display, with respect to each determination subject group, a selective element identified image in association with the determination subject group in the game image in order to allow a user to recognize the selective elements associated with the determination subject element, and also display an attribute setting state image with respect to each game element in the game image so as to discriminate a state for each attribute of the game element in order to allow the user recognize a state of each of the first attribute and the second attribute with respect to the game element.

11. A method for controlling a game system comprising a computer, the computer controlling a value for each game element displayed in a game image, based on selection of a part of a plurality of selective elements from among the plurality of selective elements by a predetermined element selection device, comprising the steps of:

setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

12. A non-transitory computer readable storage medium storing a computer program for a game system comprising a computer, the computer controlling a value for each game element displayed in a game image, based on selection of a part of a plurality of selective elements from among the plurality of selective elements by a predetermined element selection device, the computer program making the computer execute the steps of:

setting, with respect to a plurality of kinds of attributes set as factors which determine the value of the game element, a change condition for each kind of attribute in order to make a state of each kind of attribute change in relation to the selection by the element selection device, and controlling the value of the game element by changing the state of each kind of attribute based on the selection by the element selection device and the change condition set for each kind of attribute.

* * * * *